United States Patent [19]

Reeves

[11] 4,366,883

[45] Jan. 4, 1983

[54] EQUALIZING SYSTEM FOR LOAD LIFTING APPARATUS

[75] Inventor: Jerry L. Reeves, Dallas, Oreg.

[73] Assignee: Towmotor Corporation, Mentor, Ohio

[21] Appl. No.: 250,746

[22] PCT Filed: Aug. 22, 1980

[86] PCT No.: PCT/US80/01089

§ 371 Date: Aug. 22, 1980

§ 102(e) Date: Aug. 22, 1980

[87] PCT Pub. No.: WO82/00629

PCT Pub. Date: Mar. 4, 1982

[51] Int. Cl.[3] ..... B66B 9/20

[52] U.S. Cl. ..... 187/9 R; 414/631; 308/3 CH

[58] Field of Search ..... 187/9 R, 9 E, 1 A, 95; 91/171; 92/137; 254/393, 386, 29 R, 29 A, 30; 414/629, 630, 631, 632, 637, 666; 308/3 B, 3 CH, 3.9

[56] References Cited

U.S. PATENT DOCUMENTS

| | | | |
|---|---|---|---|
| 2,415,014 | 1/1947 | Luebbers | 254/386 |
| 2,787,338 | 4/1957 | Quayle | 187/9 E |
| 3,202,242 | 8/1965 | Dolphin | 414/666 |
| 3,834,668 | 9/1974 | Casey | 254/29 R |
| 4,010,825 | 3/1977 | Chelin | 187/9 R |
| 4,170,340 | 10/1979 | Mouton, Jr. | 254/386 |

FOREIGN PATENT DOCUMENTS 55-00218 3/1980 Japan .

*Primary Examiner*—Stanley H. Tollberg
*Assistant Examiner*—Kenneth Noland
*Attorney, Agent, or Firm*—Alan J. Hickman

[57] ABSTRACT

Lift trucks (12) having two laterally spaced apart motors (56,58) for lifting a load (16) on a carriage (14) provide excellent forward visability for operators thereof. When the load (16) is unevenly disposed upon the carriage (14), or the lift truck (12) encounters uneven terrain, the lifting components of the lift truck (12) are subjected to unequal stresses. Such unequal stresses, if uncorrected, reduce the useful life of the lifting components, particularly a pair of chain assemblies (70,72) associated with the carriage (14). A load equalizing system (91) maintains substantially equal tension in the pair of chain assemblies (70,72) when off-center loading is encountered. The load equalizing system (91) permits one motor (56 or 58) to move a predetermined distance relative the other (58 or 56) in response to off-center loading, which equalizes tension of the chain assemblies (70,72) and which thus extends the useful operational life of the lifting components.

6 Claims, 6 Drawing Figures

50
69
72
29
69
112
68
68
46
48
110
42
108
98
96
54
78
53
52
65
66
44
58
28
26
59
46
50
103
108
29
70
98
96
78
52
66
65
44
56
28
26
59

EQUALIZING SYSTEM FOR LOAD LIFTING APPARATUS

DESCRIPTION

TECHNICAL FIELD

The present invention relates to a load lifting apparatus having two laterally spaced apart motors, and particularly to a load equalizing system which maintains substantially equal tension in a pair of laterally spaced apart chain assemblies during load lifting operations.

BACKGROUND ART

Lift trucks having two laterally spaced apart motors, or fluid cylinders, each of which has associated therewith a respective chain assembly, provide excellent forward visability through the space between the cylinders. However, due to the wide stance of the chain assemblies, vertical rotations of a load support, such as when an off-center load is upon the load support, result in uneven tensions in the chain assemblies. These unequal tensions reduce the life of the chain assemblies, place unnecessary and unequal loading on the cylinders, and tend to over-stress other lifting components.

Devices are known to the art for single cylinder lift trucks which equalize the load between a pair of chain assemblies associated with the single cylinder. For example, U.S. Pat. No. 4,010,825, issued Mar. 8, 1977, inventor Charles R. Chelin, discloses a pivot element which is interconnected between a pair of chain assemblies and connects the chain assemblies to a carriage which carries a load. The pivot element causes equalization of the load between the chain assemblies in single engine lift trucks in response to an excessive load being imposed on one of the chain assemblies.

The present invention is directed to overcoming one or more of the problems as set forth above.

DISCLOSURE OF THE INVENTION

In one aspect of this invention, a load equalizing system is provided with a load lifting apparatus. The load lifting apparatus has a support structure, a movable structure, a load support, first and second chain assemblies and first and second linearly movable motors. The load equalizing system moves one of said motors a predetermined distance relative to the other of said motors and to said movable structure to maintain substantially equal tension in said chain assemblies.

Accordingly, unequal stresses upon the chain assemblies are substantially reduced, and the useful lives of the chain assemblies are extended.

BEST MODE OF CARRYING OUT THE INVENTION

Figure 1:
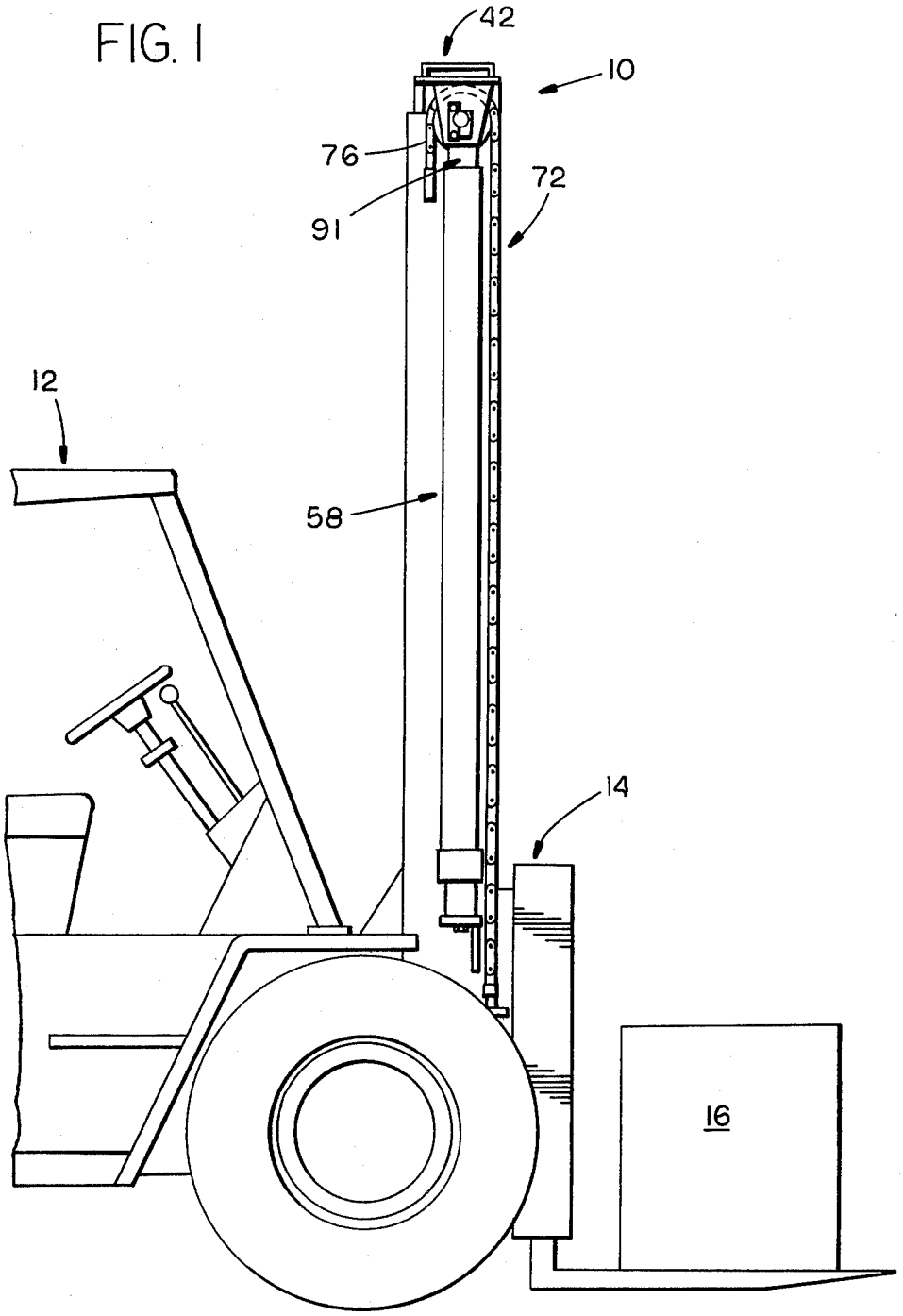
FIG. 1 is a partial side elevational view of a vehicle incorporating an embodiment of the present invention.
Figure 2:
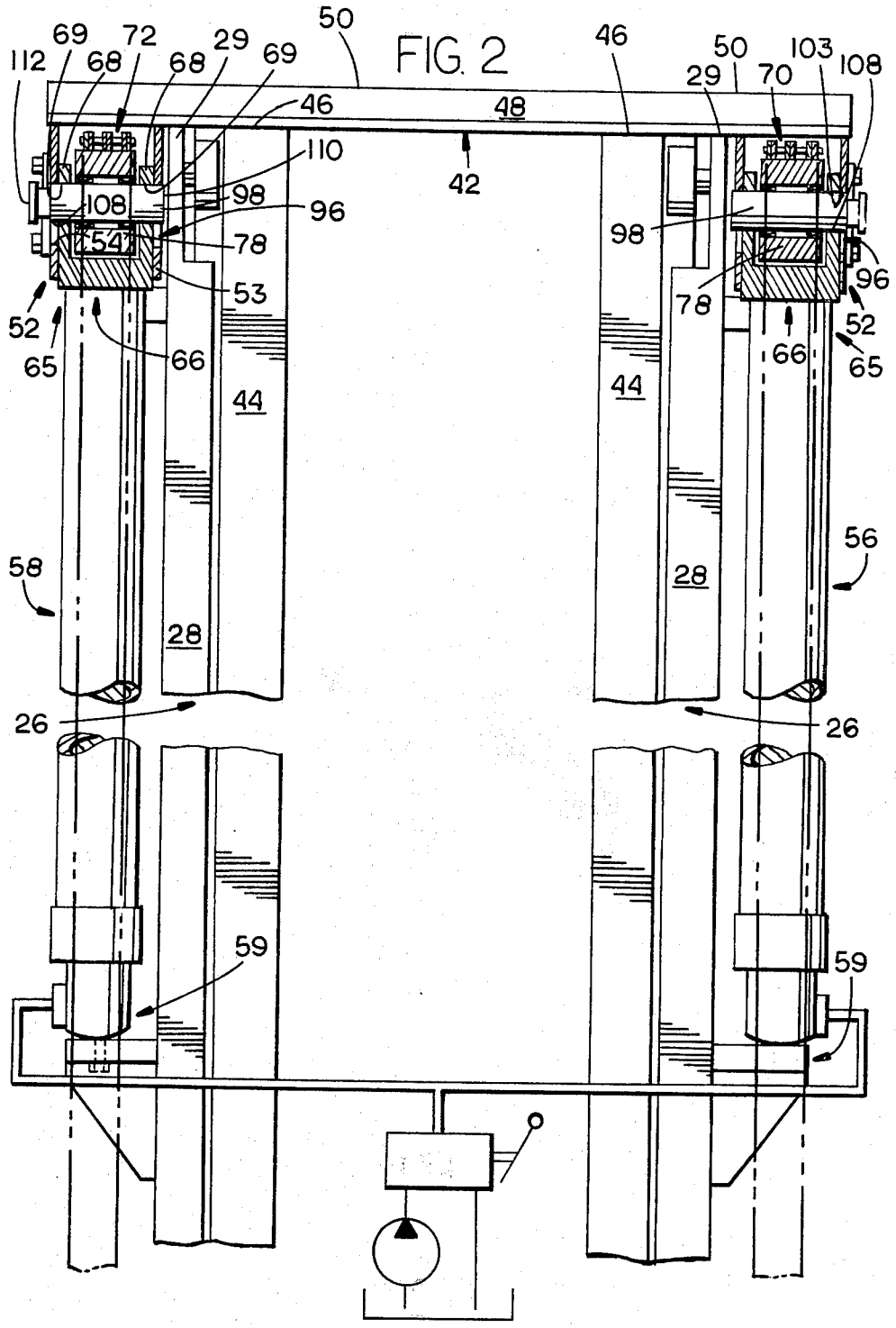
FIG. 2 is a front elevational view partially broken away and with details in section, of a vehicle as in FIG. 1.

Referring to FIG. 1, a mast assembly 10 of a load lifting apparatus, or lift truck, 12 includes a generally vertically movable carriage, or load support, 14 connected thereto and adapted to support a load 16. Referring to FIG. 2, a relatively stationary support structure 26 has a pair of laterally spaced apart, relatively stationary outer mast members 28 with upper ends 29. A movable structure 42 is mounted on support structure 26 and can be vertically moved with respect to lift truck 12. Movable structure 42 includes a pair of laterally spaced apart, inner uprights 44. Uprights 44 are interconnected at upper ends 46 thereof by a longitudinally extending tie bar 48. Tie bar 48 has distal portions 50 which transversely extend beyond uprights 44. When tie bar 48 is in a lowermost position it will rest upon upper ends 29 of outer mast members 28.

A clevis 52 is affixed to one distal portion 50 and has a downwardly depending, inboard side 53 and a downwardly depending, outboard side 54. An equivalent clevis 52 is affixed to the other distal portion 50.

A first lift cylinder, or motor, 56, and a second lift cylinder, or motor, 58, provide the power means by which movable structure 42 is vertically moved and a load is lifted. First and second lift cylinders 56, 58 are laterally spaced apart and each is preferably outboard of and generally parallel to a respective one of the outer mast members 28. Lift cylinders 56,58 are in parallel, fluid communication with each other by various conventional means, and are connected to a conventional hydraulic system.

Lift cylinders 56,58 are each connected to the support structure 26 at lower ends 59 thereof by any suitable fastening device, and each has an upper end 65 with a U-shaped bracket 66 affixed thereto. Bracket 66 has opposed sides 68 with a pair of bores 69 passing through sides 68. A pair of sheave structures 78 are each disposed between opposed sides 68 of each bracket 66. Each clevis 52 straddles a bracket 66.

A first chain, or tension, assembly 70 is trained over sheave structure 78 of cylinder 56 and a second chain, or tension, assembly 72 is trained over sheave structure 78 of cylinder 58. First and second chain assemblies 70,72 may be cables, chains or the like. Lower ends of chain assemblies 70,72 are connected to carriage 14. Upper ends 76 (one shown in FIGS. 1 and 4) of chain assemblies 70,72 are secured to a respective stationary mast member 28.

During imposition of an unevenly distributed load on carriage 14 of the above described lift truck, an equalizing system in accordance with the present invention maintains substantially equal tension on chain assemblies 70,72 and also preferably supports the mass of movable structure 42 by one cylinder (56 or 58) while the other cylinder (58 or 56) is substantially free of the mass of movable structure 42 when movable structure 42 is raised from its lowermost position. Two preferred embodiments shall now be described. Both embodiments are for moving one cylinder 56 or 58 relative to the other cylinder 58 or 56 and to movable structure 42 a predetermined distance in response to unequal tension on chain assemblies 70,72.

FIGS. 1-4 Embodiment

Figure 3:
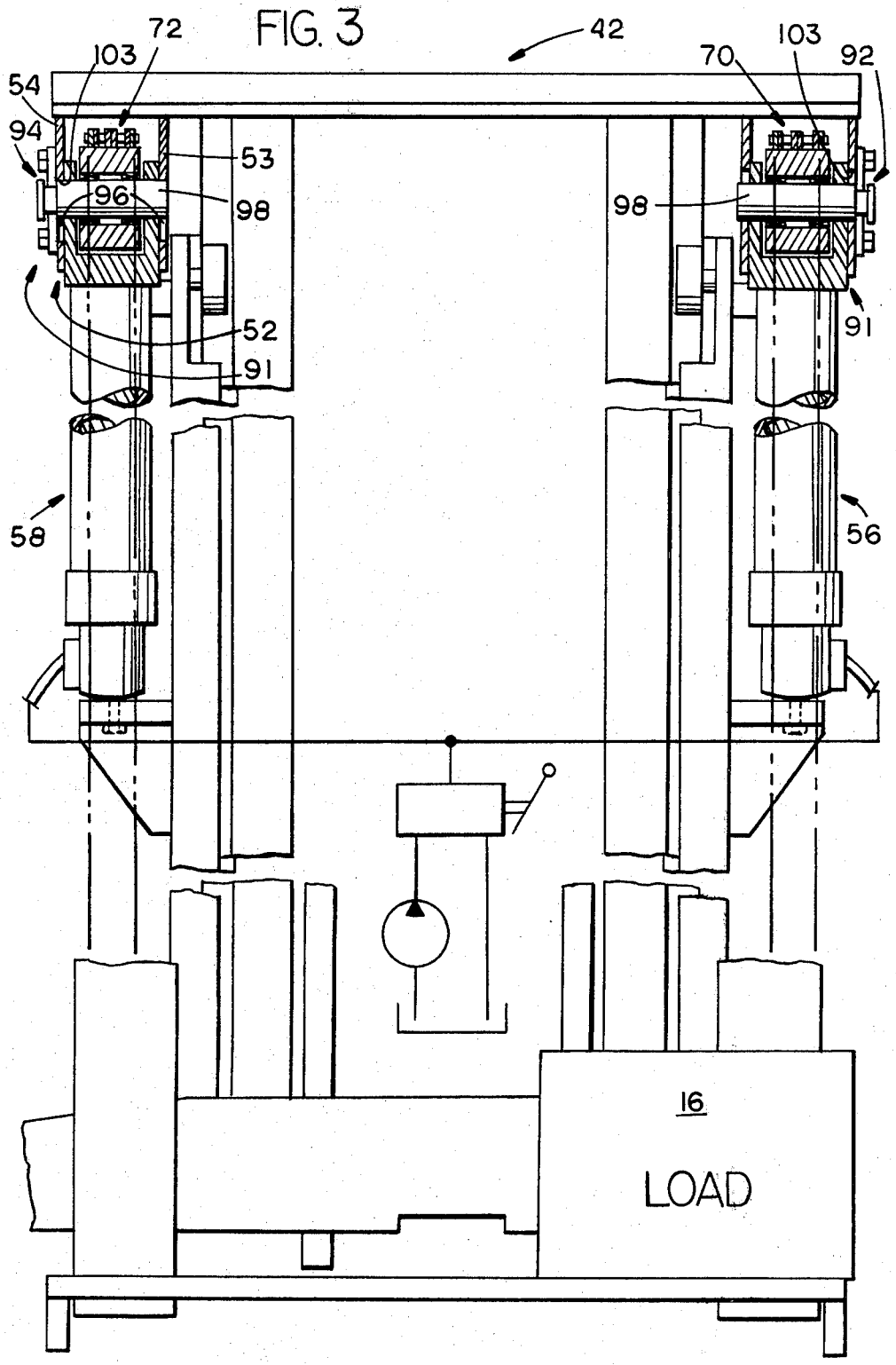
FIG. 3 is a front elevational view similar to FIG. 2, but illustrating a different relative position of components therein.

Referring generally to FIG. 3, a first embodiment, or load equalizing system 91, includes a pair of first and second guide assemblies 92,94 each associated with first and second cylinders 56, 58, respectively, and movable structure 42. First and second guide assemblies 92,94 are substantially equivalent. Thus, for convenience only second guide assembly 94 shall hereinafter be further described unless otherwise noted. Second guide assembly 94 includes a pair of vertically oriented slots 96 and a horizontally disposed pin 98 which is movable alone the slots 96.

Slots 96 are formed in clevis 52. Thus, each slot 96 may be formed in and pass through sides 53,54 respectively. The slots 96 are equivalent and are axially aligned.

Figure 4:
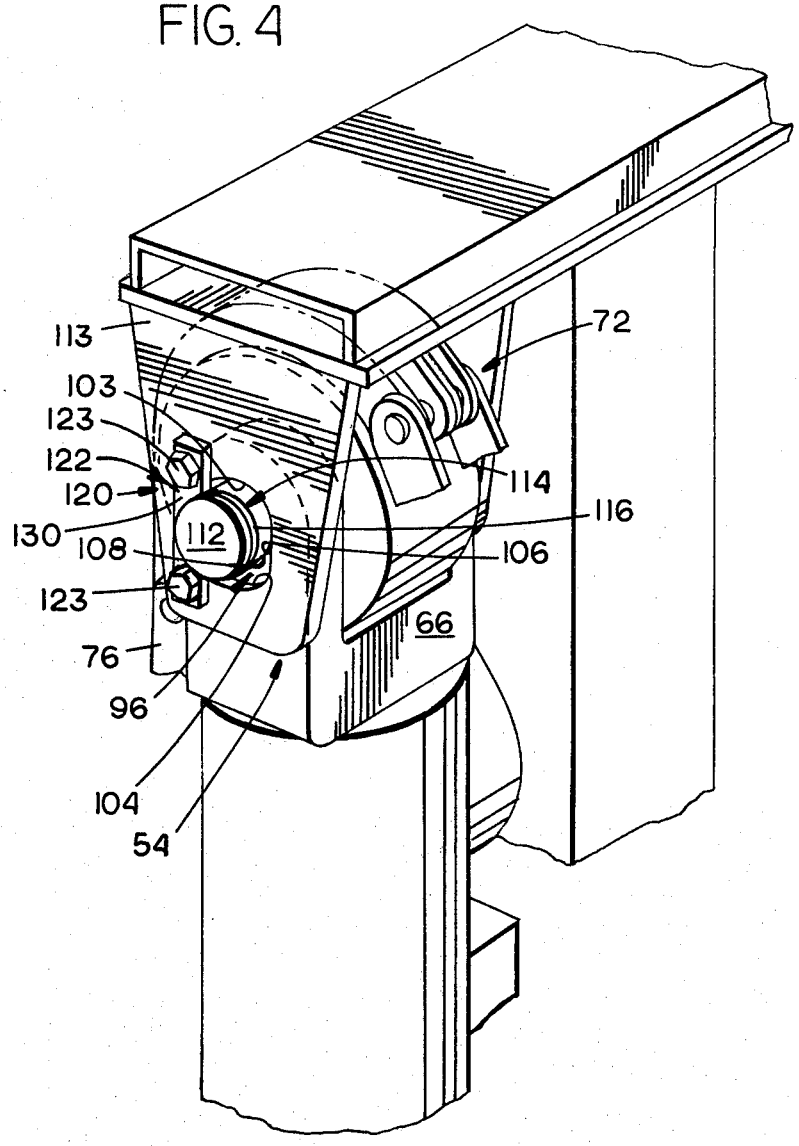
FIG. 4 is an enlarged perspective view of an embodiment detail in accordance with the present invention.

Referring to FIG. 4, one slot 96 is illustrated and is representative of both slots 96. Slot 96 has upper and lower ends 103,104 which are spaced from each other by a predetermined vertical distance, and has vertically extending sides 106 in substantially parallel relationship which are spaced from each other a predetermined horizontal distance.

Referring to FIG. 2, pin 98 is preferably cylindrical and snugly fits in and extends through bores 69 of bracket 66, with one sheave structure 78 circumferentially supported thereon. Pin 98 is closely received through bores 69 so that as fluid cylinder 58 extends and retracts, pin 98 preferably remains fixed relative bracket 66, moves with bracket 66, and is free from rotation with sheave 78.

Pin 98 extends beyond bracket 66 along outer cylindrical surfaces 108. Surfaces 108 are equivalent and each is surrounded by ends 103,104 and sides 106 of a respective slot 96. Pin 98 terminates at end portions 110,112. Ends 103,104 define a predetermined distance therebetween which is greater than the diameter of pin 98 at cylindrical surfaces 108. Thus, one cylinder 56 or 58 may be moved relative movable structure 42 the limited distance defined between ends 103,104. Such limited movement is also relative the other cylinder 58 or 56, and shall be more fully described hereinafter.

Referring to FIG. 4, end portion 112 of pin 98 is adjacent an outer surface 113 of outboard side 54 and preferably includes an annular groove 114 defining a bottom surface 116 adjacent to and radially inward of cylindrical surface 108. A keeper assembly 120 cooperates with groove 114 to prevent lateral or sideways displacements of pin 98. Keeper assembly 120 preferably is an elongated bar 122 fastened by bolts 123 to outer surface 113. A medial portion 130 of bar 122 is positioned within groove 114 close to bottom surface 116.

Figure 5:
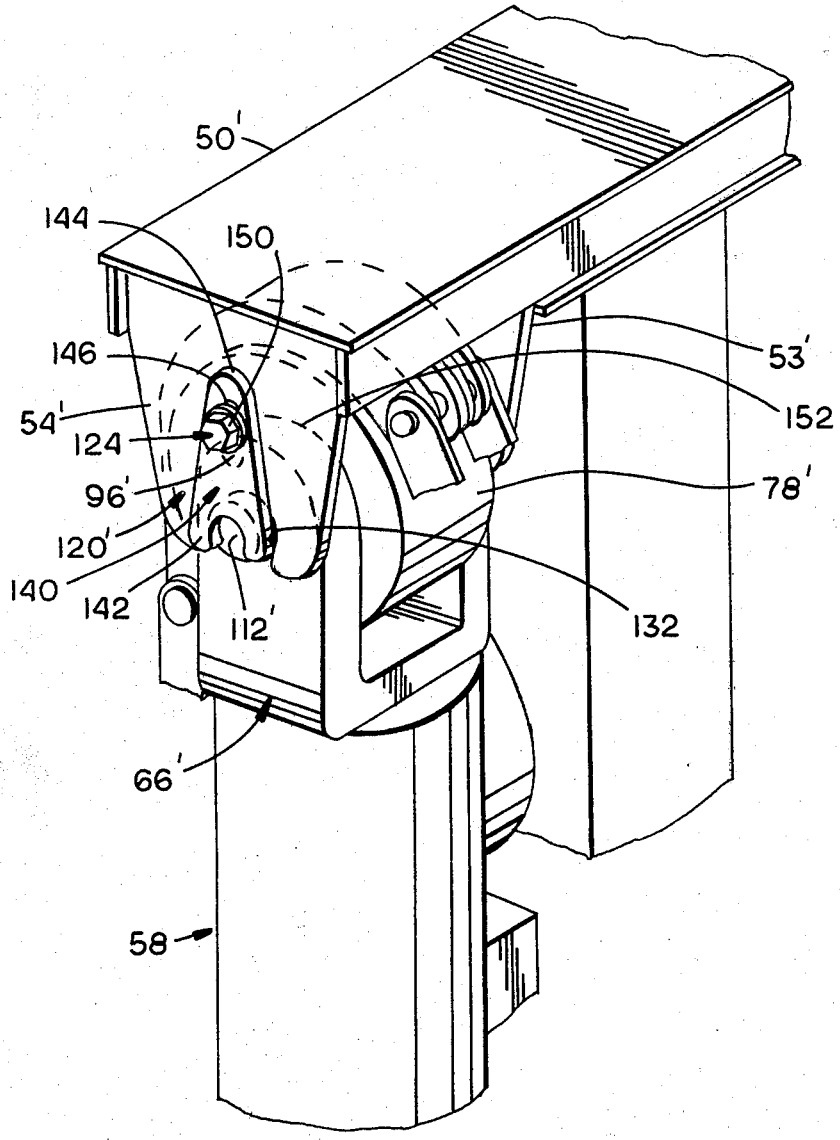
FIG. 5 is a view similar to that of FIG. 4, but of another embodiment; and, FIG. 6 is a front elevational view, partially in section, of the embodiment as in FIG. 5.
Figure 6:
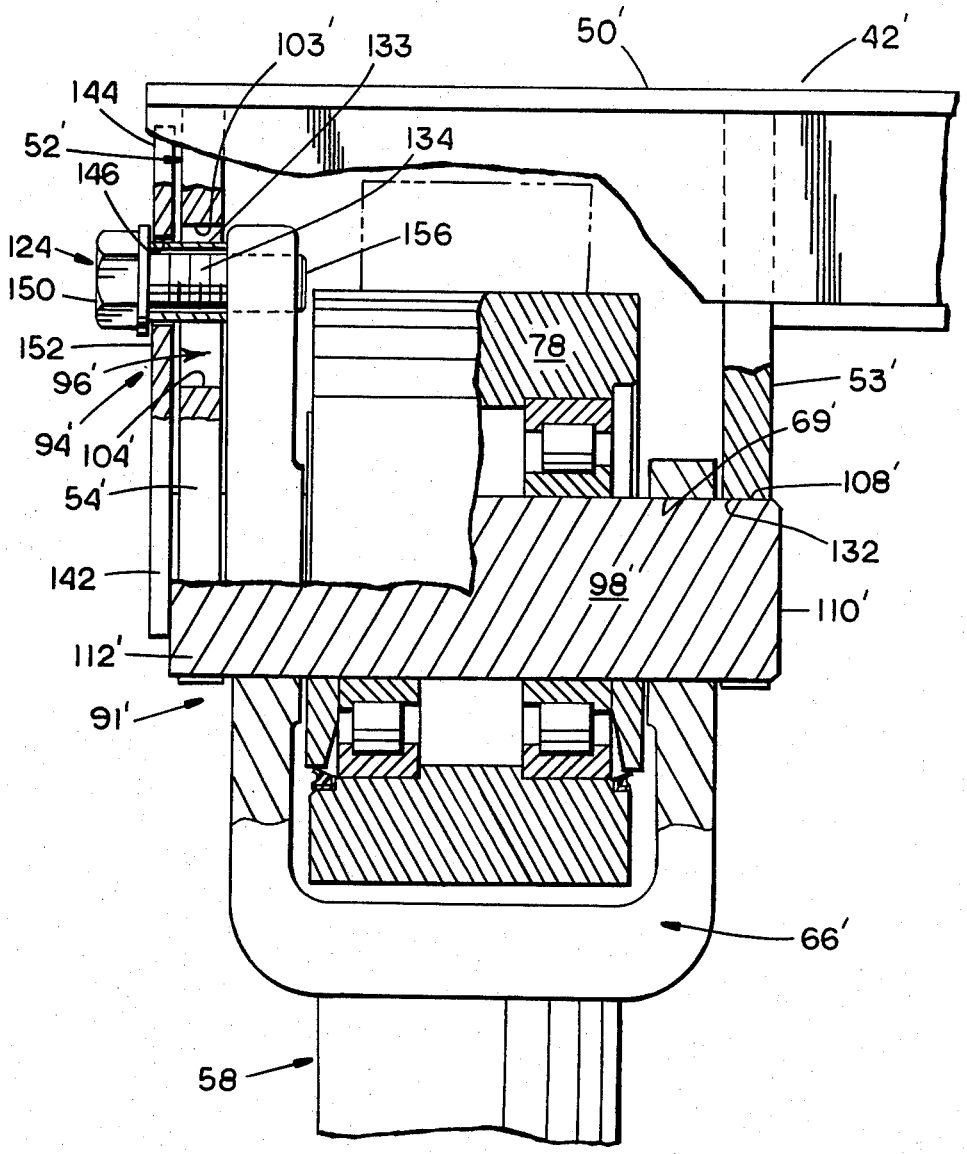

FIGS. 5-6 Embodiment

Referring to FIG. 6, a second embodiment, or load equalizing system 91', is illustrated. Like reference numerals, but with the addition of a prime symbol, shall be utilized to denote structures which are analogous to the previously described embodiment. However, no prime symbol shall be added to the reference numerals for first and second cylinders 56,58 of load equalizing system 91', which are substantially equivalent in both embodiments.

First and second guide assemblies 92',94' (only guide assembly 94' shown) are defined by respective first and second cylinders 56, 58 (only second cylinder 58 shown) and movable structure 42'. Second cylinder 58 and second guide assembly 94' are representative of both cylinders 56, 58 and of both guide assemblies 92', 94'.

Second guide assembly 94' includes a vertically oriented slot 96' in the outboard side 54' of clevis 52' and a cylindrical stop, such as a bolt 124, which is vertically movable in slot 96'. Slot 96' has upper and lower ends 103', 104' spaced from each other a predetermined vertical distance.

Pin 98' snugly fits in and extends through bores 69' of bracket 66', with one sheave structure 78' circumferentially supported thereon. Thus, pin 98' preferably remains fixed relative bracket 66', moves with bracket 66' as cylinder 58 extends and retracts, and is free from rotation with sheave 78'. Pin 98' extends beyond bracket 66' along outer cylindrical surfaces 108' and terminates at end portions 110', 112'.

Sides 53', 54' of clevis 52' depend downwardly from distal portion 50' and each terminates with a yoke-shaped surface 132. Yoke-shaped surfaces 132 each partially surround a respective cylindrical surface 108' of pin 98'. When cylinder 58 extends and retracts, pin 98' is never entirely free of yoke-shaped surfaces 132 due to bolt 124 and slot 96' as follows.

A cylindrical surface, such as tubular sleeve 133, is fitted along shaft 134 of bolt 124, and bottoms out at lower end 104' of slot 96' to prevent pin 98' from being entirely free of yoke-shaped surface 132. When shaft 134 is intermediate ends 103', 104', then cylinder 58 will be free of the mass of movable structure 42'; however, when sleeve 133 engages upper end 103', then pin 98' will be in an uppermost position relative yoke-shaped surface 132 in order to loadingly engage movable structure 42' and to support the mass of movable structure 42' by pin 98'.

Referring to FIG. 5, a keeper assembly 120' controls the amount of vertical displacements of pin 98' and also assists in supporting bolt 124 for movement in slot 96'. Keeper assembly 120' includes a plate 140 having a lower end 142 affixed by means such as welding or the like to end portion 112' of pin 98'. Upper end 144 of plate 140 includes an aperture 146 through which shaft 134 and tubular sleeve 133 pass. Slot 96' is positioned therebehind. Bolt 124 has an enlarged head 150 engagable with an outside surface 152 of plate 140.

Referring to FIG. 6, an end 156 of bolt 124 distal from head 150 is engaged with bracket 66'. Thus, as cylinder 58 extends and retracts, both keeper assembly 120' and bolt 124 move with bracket 66'.

Industrial Applicability

Load equalizing system 91 or 91' is particularly useful on a load lifting apparatus, such as a mast assembly for use on a lift truck. However, it should be made obvious to those skilled in the art relating hereto that load equalizing system 91 or 91' will find other applications wherein it is desired to maintain substantially a same tension on flexible assemblies associated with a pair of fluid cylinders.

Referring to FIG. 1, carriage 14 is in a lowermost position. Prior to lifting load 16, the entire weight of movable structure 42 is substantially equally distributed between first and second cylinders 56, 58. Thus, as illustrated by FIG. 2, surfaces 108 of both pins 98 may be located at upper ends 103 of slots 96. However, since the tie bar 48 of inner uprights 44 is at rest on the upper ends 29 of outer mast members 28, it is possible for the pins 98 to be at any location between the upper and lower ends 103, 104 of slots 96.

FIG. 3 is representative of uneven loading on first and second chain assemblies 70,72. When load 16 is unevenly disposed upon carriage 14 (or when vehicle 12 is traversing uneven terrain) and carriage 14 is supporting load 16, more of the weight of load 16 of borne by one chain assembly 70,72 than by the other. (As illustrated, more of the weight is borne by first chain assembly 70 than by second chain assembly 72.) As load 16 is lifted from such a lowered position, the tension of first chain assembly 70 would thus be greater than that of second chain assembly 72. This uneven tension, if uncorrected, would reduce the life of the chain assemblies and the sheave structures 78, and would place unnecessary loading on the cylinders 56, 58; however, load equalizing system 91 (and 91') reduces this unnecessary wear.

By comparing FIG. 2 and FIG. 3, one can envision that unevenly disposed load 16 is being lifted. FIG. 3 generally represents equalization of the uneven load situation when one chain assembly is more greatly loaded than the other. Second cylinder 58 is being supplied with fluid at the same pressure as is first cylinder 56, but second cylinder 58 is not being resisted by the additional weight of unevenly disposed load 16. Thus, the pin 98 of first cylinder 56 is adjacent lower end 104 of slot 96. However, as a consequence of the load equalizing system 91, which has permitted second cylinder 58 to move relative to first cylinder 56 and movable structure 42, the pin 98 associated with second cylinder 58 has moved to engage upper end 103, and as a consequence the relative slack in chain assembly 72 is taken up; thus both chain assemblies 70,72 approach substantially the same tension. Additionally, when pin 98 associated with second cylinder 58 engages upper end 103, then more of the mass of movable structure 42 will be borne by second cylinder 58 than by first cylinder 56, since the pin 98 of cylinder 56 will be spaced from engagement with upper end 103 of slot 96. Thus, a total mass of load 16 plus movable structure 42 will be shared between first and second cylinders 56,58. When the load 16 is unevenly disposed toward second chain assembly 72, then the same result will likewise be achieved. Accordingly, unnecessary wear upon first and second flexible assemblies 70,72 and associated components is greatly reduced during operational lives thereof.

The second embodiment, or load equalizing system 91', functions in an analogous manner since pins 98' are free to load and unload one relative the other; however, the limited movement of one of the first and second cylinders 56,58 relative to the other and relative to movable structure 42' results from the stops 124 moving in slots 96'.

Other aspects, objects, and advantages of this invention can be obtained from a study of the drawings, the disclosure and the appended claims.

I claim:

1. In a load lifting apparatus (12') having a support structure (26'), a movable structure (42') defining a mass, a load support (14'), first and second laterally spaced apart, longitudinally extending chain assemblies (70',72'), each being connected to said support structure (26') and said load support (14'), and first and second laterally spaced apart, linearly movable motors (58), each connected to said support structure (26'), said movable structure (42'), and to said first and second chain assemblies (70',72') respectively, the improvement comprising:

means (91') for permitting a predetermined amount of movement of one (56 or 58) of said motors (56,58), relative to the other (58 or 56) of said motors (58,56) and to said movable structure (42') in response to unequal tension in said first and second chain assemblies (70',72') and maintaining substantially equal tension in said chain assemblies (70',72'); said means (91') including first and second guide assemblies (92',94') defined by said first and second motors (56,58) respectively and said movable structure (42'), each of said first and second guide assemblies (92',94') having a slot (96') in said movable structure (42'), a stop (124) connected to said respective one (56 or 58) of said motors (56,58), and a pin (98') carried by said respective one (56 or 58) of said motors (56,58), said stops (124) longitudinally movable in said slots (96') between a first position and a second position via an intermediate position, in the first position the pins (98') loadingly engaging the mass of said movable structure (42'), in the second position the stops (124) loadingly engaging the mass of the movable structure (42'), and in the intermediate position the motors (56,58) being substantially free of the mass of the movable structure (42').

2. The load lifting apparatus as set forth in claim 1 wherein:

said movable structure (42') includes a pair of clevises (52') each supported on a respective one (56 or 58) of said first and second motors (56,58), said clevises (52') defining said slots (96').

3. The load lifting apparatus as set forth in claim 1 further comprising:

a pair of keeper assemblies (120') each having a respective one of said stops (124) and being of a sufficient construction for blocking transverse displacement of said stops (124) in said slots (96').

4. In a load lifting apparatus (12,12') having a support structure (26,26'), a movable structure (42,42') defining a mass, a load support (14,14'), first and second laterally spaced apart, longitudinally extending chain assemblies (70,72,70',72'), each being connected to said support structure (26,26') and said load support (14,14'), and first and second laterally spaced apart, linearly movable motors (56,58), each connected to said support structure (26,26'), said movable structure (42,42'), and to said first and second chain assemblies (70,72,70',72') respectively; the improvement comprising:

means (91,91') for permitting a predetermined amount of extension of one (56 or 58) of said motors (56,58), relative to the other (58 or 56) of said motors (58,56) and to said movable structure (42,42') in response to unequal tension in said first and second chain assemblies (70,72,70',72'), for loadingly engaging said movable structure (42,42') and moving said movable structure (42,42') to an elevated position in response to extension of both of said motors (56,58) after the predetermined amount of extension of one (56,58) of said motors (58,56), for loadingly engaging said movable structure (42,42') and urging said movable structure (42,42') to a lowered position in response to retraction of at least one (56,58) of said motors (56,58);

said means (91) having first and second guide assemblies (92,94) defined by said first and second motors (56,58) respectively and said movable structure (42), each of said first and second guide assemblies (92,94) having a plurality of slots (96) and a pin (98), each of said pins (98) being longitudinally movable in a related pair of said slots (96);

said movable structure (42) having a pair of clevises (52), each of said clevises (52) straddling a respective one of said first and second motors (56,58) and defining said related pair of said slots (96) therein, and said first and second motors (56,58) each carry said related pin (98); and a pair of keeper assemblies (120), each of said keeper assemblies (120) being positioned adjacent a related one of said pins (98) and being of a construction sufficient for maintaining said pins (98) from transverse displacements in said related pair of said slots (96).

5. In a load lifting apparatus (12,12') having a support structure (26,26'), a movable structure (42,42') defining a mass, a load support (14,14'), first and second laterally spaced apart, longitudinally extending chain assemblies (70,72,70',72'), each being connected to said support structure (26,26') and said load support (14,14'), and first and second laterally spaced apart, linearly movable motors (56,58), each connected to said support structure (26,26'), said movable structure (42,42'), and to said first and second chain assemblies (70,72,70',72') respectively; the improvement comprising:

means (91,91') for permitting a predetermined amount of extension of one (56 or 58) of said motors (56,58), relative to the other (58 or 56) of said motors (58,56) and to said movable structure (42,42') in response to unequal tension in said first and second chain assemblies (70,72,70',72'), for loadingly engaging said movable structure (42,42') and moving said movable structure (42,42') to an elevated position in response to extension of both of said motors (56,58) after the predetermined amount of extension of one (56,58) of said motors (58,56), for loadingly engaging said movable structure (42,42') and urging said movable structure (42,42') to a lowered position in response to retraction of at least one (56,58) of said motors (56,58), and for supporting the mass of said movable structure (42,42') by said one (56,58) of said motors (56,58) when said one (56 or 58) of said motors has been extending said predetermined amount, while the other (58 or 56) of said motors (56,58) is substantially free of the mass of said movable structure (42,42');

said means (91') having first and second guide assemblies (92',94') defined by said first and second motors (56,58) respectively and said movable structure (42'), each of said first and second guide assemblies (2',94') having a slot (96') in said movable structure (42') and a stop (124) connected to said respective one (56,58) of said motors (56,58), said stops (124) longitudinally movable in said slots (96');

said movable structure (42') having a pair of clevises (52') each supported on a respective one (56 or 58) of said first and second motors (56,58), said clevises (52') defining said slots (96'); and a pair of keeper assemblies (120') each having a respective one of said stops (124) and being of a sufficient construction for blocking transverse displacement of said stops (124) in said slots (96').

6. In a load lifting apparatus (12) having a support structure (26), a movable structure (42) defining a mass, a load support (14), first and second laterally spaced apart, longitudinally extending chain assemblies (70,72), each being connected to said support structure (26) and said load support (14), and first and second laterally spaced apart, linearly movable motors (56), each connected to said support structure (26), said movable structure (42), and to said first and second chain assemblies (70,72) respectively; the improvement comprising:

means (91) for permitting a predetermined amount of movement of one (56 or 58) of said motors (56,58), relative to the other (58 or 56) of said motors (58,56) and to said movable structure (42) in response to unequal tension in said first and second chain assemblies (70,72) and maintaining substantially equal tension in said chain assemblies (70,72), said means (91) including a pair of clevises (52) of said movable structure (42) and a pair of pins (98) carried by a respective each of said first and second motors (56,58), each of said clevises (52) defining a pair of slots (96), each of said pins (98) being longitudinally movable in a pair of related slots (96) between a first position and a second position via an intermediate position, in the first and second positions the pins (98) loadingly engaging the mass of said movable structure (42), in the intermediate position the pins (98) being substantially free of the mass of said movable structure (42); and a pair of keeper assemblies (120), each of said keeper assemblies (120) being positioned adjacent a related one of said pins (98) and being of a sufficient construction for maintaining said pins (98) from transverse displacements in said related pair of said slots (96).

* * * * *